US007434395B2

(12) United States Patent
He

(10) Patent No.: US 7,434,395 B2
(45) Date of Patent: Oct. 14, 2008

(54) APPARATUS AND METHOD FOR DUAL MODE COMPACT HYDRAULIC SYSTEM

(75) Inventor: Xinhua He, Troy, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/781,158

(22) Filed: Jul. 20, 2007

(65) Prior Publication Data

US 2008/0022672 A1 Jan. 31, 2008

Related U.S. Application Data

(63) Continuation-in-part of application No. 11/618,924, filed on Jan. 1, 2007.

(60) Provisional application No. 60/833,018, filed on Jul. 25, 2006.

(51) Int. Cl.
*F15B 15/18* (2006.01)
*F04B 1/20* (2006.01)

(52) U.S. Cl. ..... 60/476; 60/475

(58) Field of Classification Search ..... 60/473, 60/475, 476, 415; 91/1; 92/5 R
See application file for complete search history.

(56) References Cited

U.S. PATENT DOCUMENTS 2,457,467 A * 12/1948 Hartman ..... 60/476
2,927,429 A * 3/1960 Carlson ..... 60/475
3,003,317 A * 10/1961 Schroeder et al. ..... 60/394
5,444,979 A * 8/1995 Funami et al. ..... 60/476
6,282,893 B1 * 9/2001 Porter et al. ..... 60/477
6,543,223 B2 * 4/2003 Muschong et al. ..... 60/476
6,796,120 B2 * 9/2004 Franchet et al. ..... 60/475
7,281,372 B2 * 10/2007 Sakai et al. ..... 60/476
2002/0127126 A1 * 9/2002 Kaempe ..... 418/206.1

* cited by examiner

*Primary Examiner*—Thomas E Lazo
(74) *Attorney, Agent, or Firm*—Douglas D. Fekete

(57) ABSTRACT

A dual mode hydraulic actuator, comprising: a housing; a rod secured to a piston, the rod and piston being slidably received within the housing; a first chamber positioned on one side of the piston; a second chamber positioned on another side of the piston; a sealed reservoir; a fluid disposed in the first chamber, the second chamber and the reservoir; a bidirectional pump for moving the fluid between the first chamber, the second chamber and the sealed reservoir; a bi-mode control valve for providing selective fluid communication between the first chamber, the second chamber and the sealed reservoir, wherein the bi-mode control valve is spring biased into a neutral position wherein fluid communication between the first chamber, the second chamber and the sealed reservoir is prevented; and wherein the bi-mode control valve is capable of being manually manipulated into a manual mode position wherein fluid flow from the first chamber to the second chamber is provided and fluid flow from or to the sealed reservoir is also provided, the fluid flow from or to the sealed reservoir being dependant upon a volume of fluid in the first chamber and the second chamber.

20 Claims, 14 Drawing Sheets

APPARATUS AND METHOD FOR DUAL MODE COMPACT HYDRAULIC SYSTEM

CROSS REFERENCE TO RELATED APPLICATIONS

This application claims the benefit of U.S. Provisional Patent Application Ser. No. 60/833,018 filed Jul. 25, 2006, the contents of which are incorporated herein by reference thereto.

This application is a continuation in part of U.S. patent application Ser. No. 11/618,924 filed Jan. 1, 2007, the contents of which are incorporated herein by reference thereto.

BACKGROUND

The present invention relates to hydraulic system. More particularly, the present invention relates to an apparatus and method for providing a dual mode compact hydraulic system.

Hydraulic actuators are commonly found in many engineered systems for a wide range of applications, including military, space, aerospace, and many industrials. Generally, a hydraulic system includes some elements such as a pump, a fluid supplier (reservoir), a connecting piping system, a closed hydraulic cylinder, and necessary control valves, etc. An electrical motor is commonly used to drive the hydraulic pump to pressurize the fluid for function. Traditionally, those elements of the hydraulic system are so designed as sub-system and/or sub-components that are not fully integrated.

Some disadvantages of prior hydraulic actuators are that the system is not compact, connecting pipes provide potential areas for leakage, and the reservoir must be oriented and installed to compensate for the effects of gravity on the reservoir. In addition, these systems are usually operated by power and are not manually overridden. Thus, these systems have limitations or are not suitable for applications that require a self-contained, fully integrated compact hydraulic system, which can be operated both by power and/or manually.

Accordingly, it is desirable to provide a compact integrated hydraulic system with dual power and manual operational modes.

SUMMARY OF THE INVENTION

This disclosure relates to an apparatus and method for a dual mode compact hydraulic system.

In one exemplary embodiment, a dual mode hydraulic actuator is provided, the dual mode actuator comprising: a housing; a rod secured to a piston, the rod and piston being slidably received within the housing; a first chamber positioned on one side of the piston and within the housing; a second chamber positioned on another side of the piston and within the housing; a sealed reservoir disposed within the housing; a fluid disposed in the first chamber, the second chamber and the reservoir; a bidirectional pump for moving the fluid between the first chamber, the second chamber and the sealed reservoir; a bi-mode control valve for providing selective fluid communication between the first chamber, the second chamber and the sealed reservoir, the bi-mode control valve being biased into a neutral position wherein fluid communication between the first chamber, the second chamber and the sealed reservoir is prevented and the bi-mode control valve being capable of being manually manipulated into an open flow position wherein fluid flow from the first chamber to the second chamber is provided and fluid flow from or to the sealed reservoir is also provided, the fluid flow from or to the sealed reservoir being dependant upon a volume of fluid in the first chamber and the second chamber.

In another exemplary embodiment a dual mode hydraulic actuator is provided, the dual mode hydraulic actuator comprising: a housing; a rod secured to a piston, the rod and piston being slidably received within the housing, wherein the rod along with the piston is capable of movement between a first position and a second position; a first chamber positioned on one side of the piston and within the housing; a second chamber positioned on another side of the piston and within the housing; a self contained flexible volume compensator disposed within the housing; a fluid disposed in the first chamber, the second chamber and the self contained flexible volume compensator, wherein the fluid in the self contained flexible volume compensator is pressurized to a predetermined pressure level; a bidirectional pump for moving the fluid between the first chamber, the second chamber and the self contained flexible volume compensator; a bi-mode control valve disposed in the housing and for providing selective fluid communication between the first chamber, the second chamber, the bidirectional pump and the self contained flexible volume compensator as the rod moves in a range of movement defined by the first position and the second position, wherein the bi-mode control valve isolates the first chamber from the self contained flexible volume compensator and the second chamber when a fluid pressure in at least one of the first chamber, the second chamber and the self contained flexible volume compensator is below a predetermined level and the pressurized fluid in the self contained flexible volume compensator is transferred from the self contained flexible volume compensator to the second chamber via the pump during a powered mode of operation or through the bi-mode control valve during a manual mode of operation.

In another exemplary embodiment a method for actuating a rod of a hydraulic actuator is provided, the method comprising: pressurizing a fluid in a self contained flexible volume compensator of the hydraulic actuator; and displacing a portion of the fluid of the self contained flexible volume compensator into a second chamber of the hydraulic actuator as a rod of the hydraulic actuator moves from a first position towards a second position wherein a piston coupled to the rod increases a volume of the second chamber and decreases a volume of a first chamber, wherein a portion of a fluid in the second chamber is transferred to the self contained flexible volume compensator when the rod moves from the second position to the first position, and wherein the self contained flexible volume compensator, the first chamber and the second chamber are disposed within a housing of the hydraulic actuator and a bi-mode control valve disposed in the housing, the bi-mode control providing selective fluid communication between the first chamber, the second chamber and the self contained flexible volume compensator as the rod moves in a range of movement defined by the first position and the second position, wherein the bi-mode control valve isolates the first chamber from the self contained flexible volume compensator and the second chamber when the bi-mode control valve is biased into a neutral position.

DETAILED DESCRIPTION OF EXEMPLARY EMBODIMENTS

Figure 1:
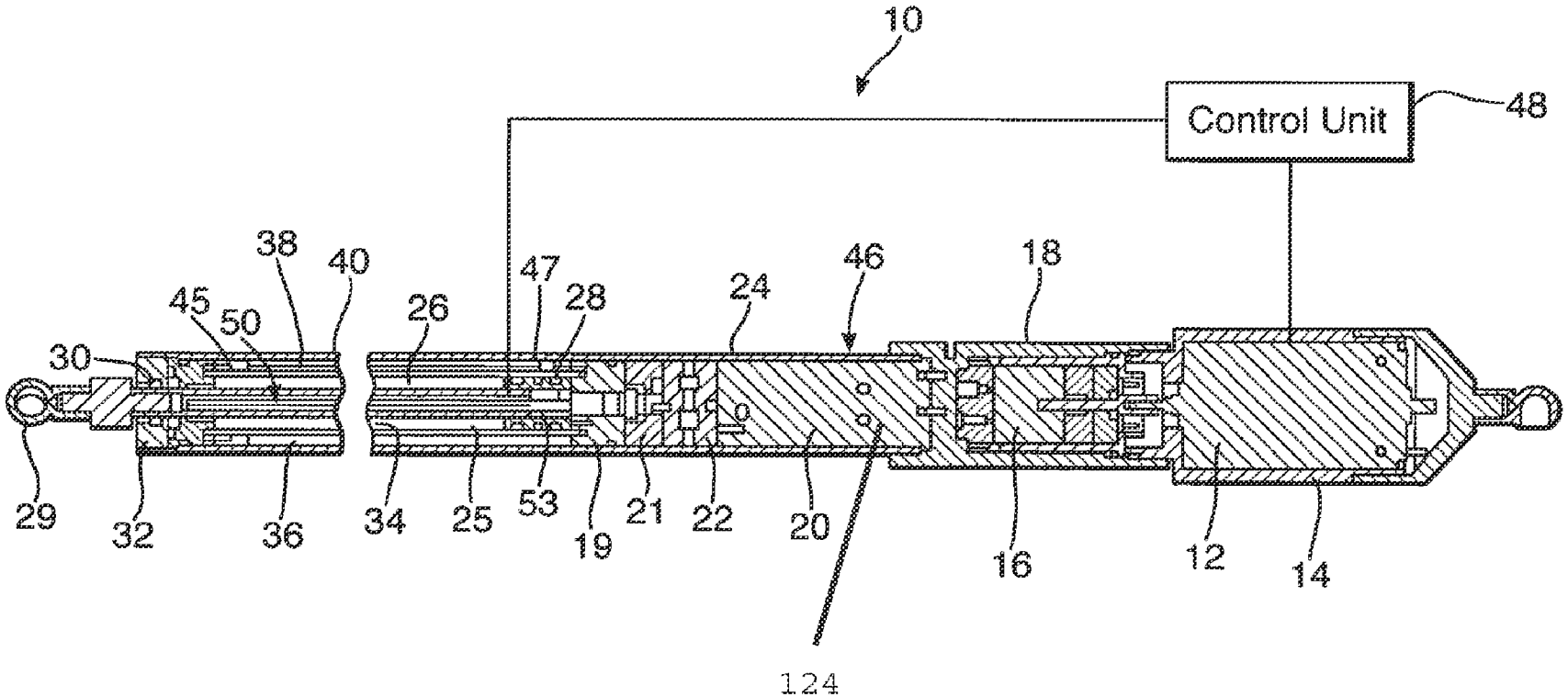
FIG. 1 is a cross sectional view of a hydraulic actuator constructed in accordance with an exemplary embodiment of the present invention.

This application is related to U.S. Provisional Patent Application Ser. No. 60/757,663 filed Jan. 10, 2006, the contents of which are incorporated herein by reference thereto.

This application is also related to U.S. patent application Ser. No. 11/618,924 filed Jan. 1, 2007, the contents of which are incorporated herein by reference thereto.

The disclosure of the present application relates to an integrated, self-contained, compact hydraulic system with both power and manual operational modes. The integrated, self contained, compact hydraulic system in one exemplary embodiment will comprise: an electrical motor, a hydraulic pump, integrated and/or modulated hydraulic control units, a flexible volume device, a closed hydraulic cylinder with an output rod, and an optional sensor. All of the sub-systems and components may be modular units. Based upon specific applications the integration and assembly of the modular units may be varied. In accordance with an exemplary embodiment of the present invention the hydraulic systems may be operated in both power and manual operational modes.

In one non-limiting exemplary embodiment, the closed hydraulic cylinder comprises a piston, flow channels, an outer tube, an inner tube, an output rod or alternatively an inner tube as an output rod, an optional position or pressure sensor system, a top cap, a base cap, and seals. The flow channels may be located between the inner and outer tubes positioned by the top and base caps. The flow channel will connect the upper chamber and the inlet channel. The movable tube may also be an optional inner flow channel, or as a housing for the optional position sensor system. There may be a stable device between the piston and the optional sensor system. The top cap will have an opening for the output rod. The base cap will have ports which connect with the modulated hydraulic units. The modulated hydraulic units pump and motor modules may be attached to the base cap in sequence. The self-contained flexible volume device may be resident anywhere between modules, such as between the cylinder and valves, or between the valves and pump module.

A dual operational module includes an integrated bi-mode control valve, which in a power mode can be solenoid driven with at least two pilot check valves. The dual-mode control module may be resident anywhere beside or between modules, such as beside the cylinder, or beside the pump module, or between the cylinder and the pump module.

In another non-limiting exemplary embodiment, the closed hydraulic cylinder comprises a piston, a flow channel, an outer tube, an inner tube, an output rod, an optional position or pressure sensor system, a top cap, a base cap, a flexible volume compensator, and seals. The flow channel may be located between the inner and outer tubes and positioning by the top and base caps. It will connect the inner chamber and inlet channel. The output rod may also serve as a housing for an optional sensor system. The flexible volume compensator may be located between the inner and outer tubes. The top cap will have an opening for the output rod. The base cap will have ports which can connect with the modulated hydraulic units. The modulated hydraulic units and pump and motor may be attached to the base cap in sequence. The self-contained flexible volume device, in this design, may be resident between the inner and the outer tubes.

In accordance with an exemplary embodiment of the present invention, the elements are all designed and arranged in-line with the hydraulic cylinder so that a compact package, particularly compact in diameter, can be achieved. The compact hydraulic system with optional modules may be assembled together within a tube-like housing.

The fluid flow channels and ports among the pump, control units, and the flexible volume device, and cylinder are so designed that channels and ports may be connected through the contact surfaces.

In accordance with an exemplary embodiment numerous design variations are contemplated. For example, the selection of integrated-modulated hydraulic units may be optional and exchangeable based upon the application requirements. In addition, solenoid driven valve(s), and/or pressure driven switch(es) can employed, the control switch(es) may also be added to the control system as another optional feature.

In one non-limiting exemplary embodiment, the dual operational module comprises an integrated solenoid driven valve and pilot check valves. The dual-mode control module may be resident anywhere beside or between modules, such as beside the cylinder, or beside the pump module, or between the cylinder and the pump module. The pump may be any one of numerous types available, non-limiting examples include gear pumps, piston pumps, screw-type pumps, or vane pumps, etc.

In accordance with an exemplary embodiment, the self-contained flexible volume device may be pre-loaded, or pre-pressurized. The means to pre-load, or pre-pressure the flexible volume device include, but are not limited to, spring loaded compensator, an accumulator with compressed air, or an pressurized bladder made from rubber-like materials. In some cases, it can be pressurized by atmosphere as well.

The assembly of the modulated compact hydraulic system may vary based upon the package and application needs. For example, the cylinder may remote from the pump/motor/control modules and they can each be connected through hydraulic links, namely tubing or hoses. In addition, the control module(s) can be remotely located and connected to the cylinder, pump/motor through hydraulic links, namely tubing or hoses. The control module(s) can also be integrated into the cylinder module, or the pump/motor module. The control modules can also be physically attached to the cylinder module, or the pump module.

In accordance with an exemplary embodiment there are numerous application variations. For example, the installation of the modulated compact hydraulic system may be mounted by attaching elements to a suitable base and a movable device. The modulated compact hydraulic system may be used to connect two movable objects. In those cases, both force and motion will be the outputs. In case of the assembly to link two stationary bases, no motion output from the cylinder rod will be allowed and the force will be the only output.

Exemplary embodiments of the present invention relate to an integrated, self-contained, compact in-line hydraulic system. In one exemplary embodiment, the modular compact in-line hydraulic system is used as an actuator for automotive applications, such as driving a side door, tail gate, sliding door, deck lit, etc. In another exemplary embodiment, the modular compact in-line hydraulic system can also be used as a driving device for many other industrial fields where a compact in-line actuator system is desired, such as medical machines, health and sport training machines, assembly stations or lines, testing machines, lifting or actuating units in aerospace industries, etc.

Figure 2:
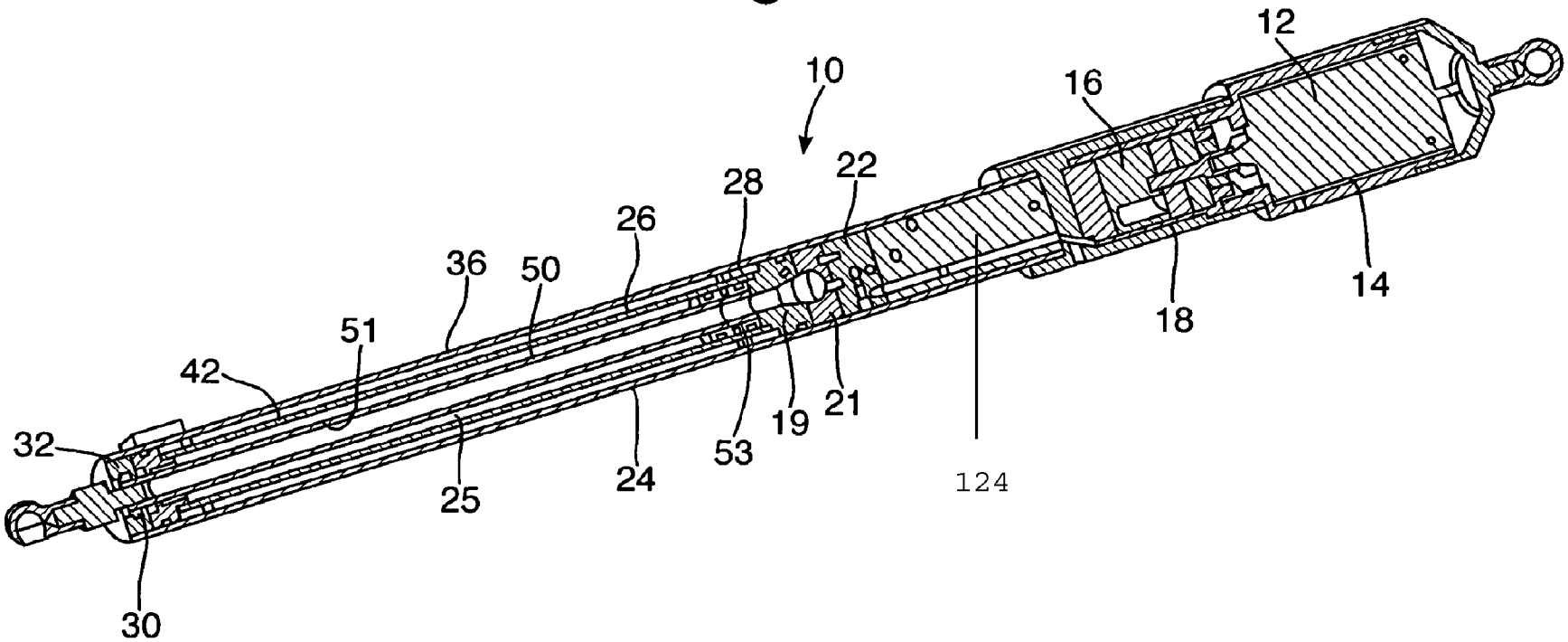
FIG. 2 is a cross sectional perspective view of a compact actuator constructed in accordance with an exemplary embodiment of the present invention.
Figure 3:
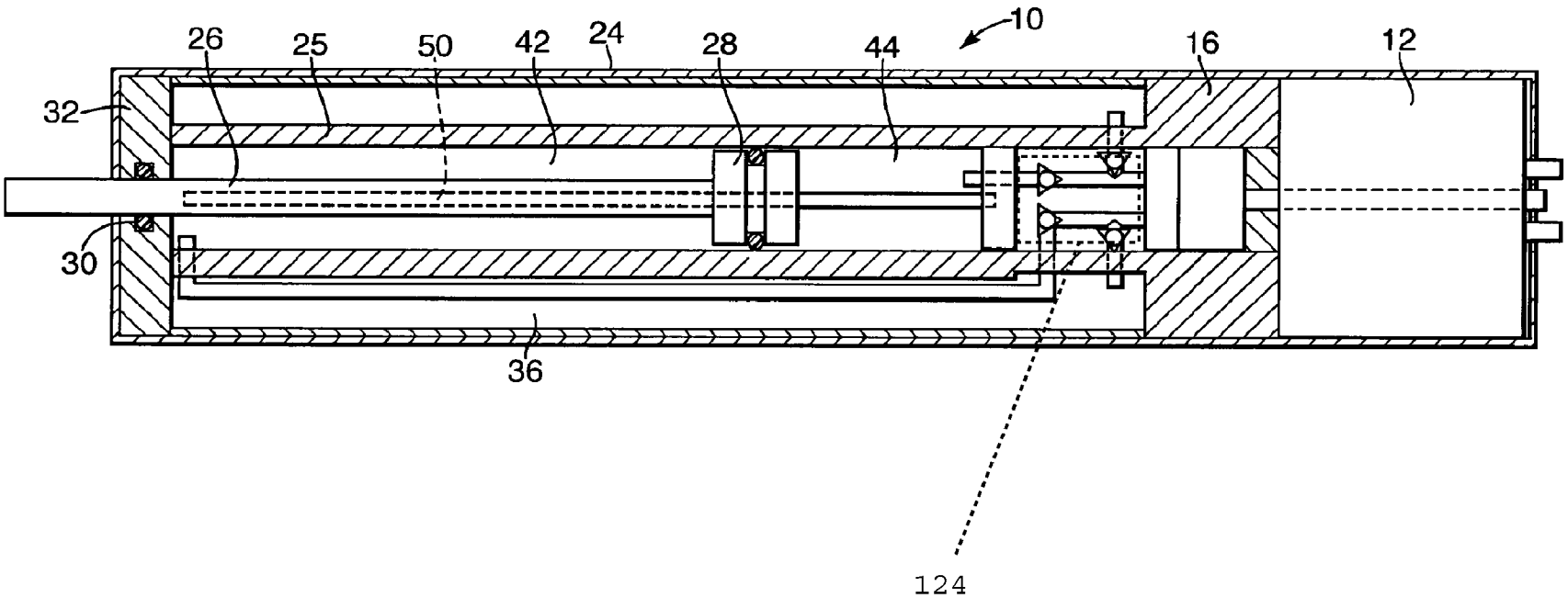
FIG. 3 is a cross sectional schematic view of a hydraulic actuator constructed in accordance with an exemplary embodiment of the present invention.

Referring now to FIGS. 1-3 a hydraulic actuator 10 in accordance with an exemplary embodiment of the present invention is illustrated. In accordance with an exemplary embodiment of the present invention, hydraulic actuator 10 comprises an integrated, self contained, compact in-line hydraulic system. Hydraulic actuator 10 includes an electrical motor 12 disposed in a motor housing 14. The electric motor is coupled to a hydraulic pump 16 disposed in a pump housing 18, wherein the pump housing is secured to the motor housing. Many types of fluid pumps can be used in exemplary embodiments of the present invention. Some pumps include but are not limited to gear pumps, piston pumps, screw type pumps, or vane pumps, etc. Pump 16 is configured to provide fluid to a plurality of valve modules 20 and 22, which are disposed within an actuator housing or closed hydraulic cylinder 24. In accordance with an exemplary embodiment the fluid is a hydraulic fluid or any other suitable fluid having characteristics suitable for use in exemplary embodiments of the present invention. In accordance with an exemplary embodiment valve modules 20 and 22 are in fluid communication with the pump and chambers of the hydraulic actuator through optional transition plates 19 and 21. As will be discussed herein the transition plates will be used with an optional sensor system for determining the movement of the rod within the housing. Alternatively, and if the optional sensor system requiring the transition plates is not used there will be no need for the transition plates. In yet another alternative embodiment, the actuator may be configured to have a sensor that does not require a transition plate. Although motor housing 14, pump housing 18 and actuator housing 24 are shown as separate items secured together it is understood that alternative exemplary embodiments contemplate a single or two housing structures for housing each of the components being secured together in a linear fashion.

Figure 2A:
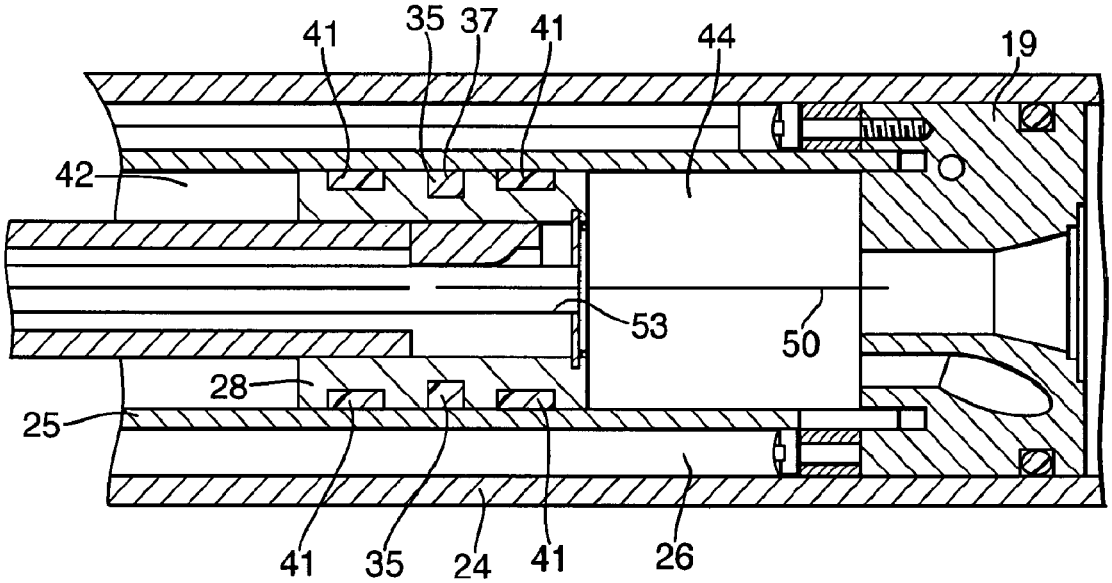
FIG. 2A is an enlarged partial cross sectional view of a portion of an exemplary embodiment of the present invention.

Disposed within actuator housing or closed hydraulic cylinder 24 is an inner cylinder 25 defining a chamber for slidably receiving an output rod 26 that has a piston 28 at one end and an actuation end 29 at the other. The output rod is configured to move within a sealed opening 30 of an end cap 32 as piston 28 moves within a chamber 34 of cylinder 25. As shown, piston 28 is configured to provide a seal between chambers 42 and 44 via a seal ring 35 or a plurality of seal rings disposed about the periphery of the piston so that substantially no fluid from the first chamber may leak directly into the second chamber through the piston and vice versa as the piston moves within the chamber 34 of cylinder 25. In one non-limiting exemplary embodiment and as illustrated in FIG. 2A the seal ring is a Teflon material disposed about the periphery of the piston. In another embodiment, the seal ring comprises a copper material or copper alloy or equivalent thereof. In another alternative exemplary embodiment, an O-ring 37 may be used in conjunction with the seal ring wherein the O-ring is disposed between the seal ring and the piston by for example, the O-ring and the seal ring may be disposed in a groove 39 located on the surface of the piston. In addition, a stable device, guide device or wear ring or a plurality of wear rings 41 may be disposed about the piston and at either side of the seal ring to prevent rotation and twisting of the piston as the piston and rod move within the housing. This will prevent the piston from being angularly displaced, which may damage the housing and the seal about the rod. In addition, the guide device will ensure a more accurate sensing of the piston as it moves in the cylinder.

In accordance with one exemplary embodiment cylinder 25 and accordingly chamber 34 is configured to be positioned within actuator housing 24 so that a compensator or compensation chamber or self-contained flexible volume compensator 36 is disposed between an exterior surface 38 of the cylinder 25 and an interior surface 40 of the actuator housing or closed hydraulic cylinder 24 thus providing a compensator 36 that surrounds or partially surrounds cylinder 25. In one exemplary embodiment, the compensator provides a portion of the flow path between the first and second chambers thus additional flow conduits are not required. In accordance with an exemplary embodiment a first chamber 42 is disposed on one side of the piston and a second chamber 44 is positioned on the other side of the piston as the piston moves linearly within chamber 34. In accordance with an exemplary embodiment and as the rod moves into and out of the actuator housing the volume or size of the first and second chambers will vary accordingly. This is due to the corresponding movement of piston 28 as rod 26 moves therein.

In accordance with an exemplary embodiment of the present invention, the first chamber is in selective fluid communication with the compensation chamber and the second chamber via a valve system 46 disposed within the plurality of valve modules and the housings/cylinders. In accordance with an exemplary embodiment the valve system comprises a plurality of valves and flow channels. As will be discussed herein, a first valve subassembly 45 will provide selective fluid communication between the self-contained flexible volume compensator 36, pump 14, and the first chamber 42 while a second valve subassembly 47 will provide selective fluid communication between the self-contained flexible volume compensator 36, pump 14 and the second chamber 44. In accordance with an exemplary embodiment of the present invention and as will be discussed herein first valve subassembly 45 comprises a counterbalance valve, a check valve and a pilot check valve some of which are configured to provide fluid flow in one direction only. Of course and as applications require, other types of valve mechanisms may be employed. In addition and in accordance with an exemplary embodiment of the present invention second valve subassembly will also comprise a counterbalance valve, a check valve and a pilot check valve some of which are configured to provide fluid flow in one direction only. Again, other types of valve mechanisms may be employed.

Accordingly and in accordance with an exemplary embodiment, the motor is coupled to a control unit 48 wherein operational signals are provided to energize the motor that drives the pump to pump fluid to and from the first chamber, the second chamber and the self contained flexible volume compensator to manipulate the position of the output rod. In accordance with an exemplary embodiment of the present invention, the control unit or control module may be located within the actuator or remotely located as long as the operational signals to and from the control unit are capable of being received and transmitted.

In addition, and as an alternative exemplary embodiment a sensor 50 is provided to provide signals indicative of the movement of the output rod to the control unit wherein the signals are used to energize or de-energize the motor corresponding to the position of the output rod. In accordance with an exemplary embodiment the sensor is a transducer or variable resistor configured to track the movement or presence of the output rod and provide a signal indicative of the rod's position back to the control unit. In accordance with an exemplary embodiment sensor 50 is a potentiometer or variable resistor wherein a pot is used to as the primary choice of transducer for converting mechanical position of the rod and/or piston into an electrical signal that can be used by the controller. In accordance with an exemplary embodiment and as the rod and cylinder move the setting (and the resistance) of the pot is being changed.

Figure 2B:
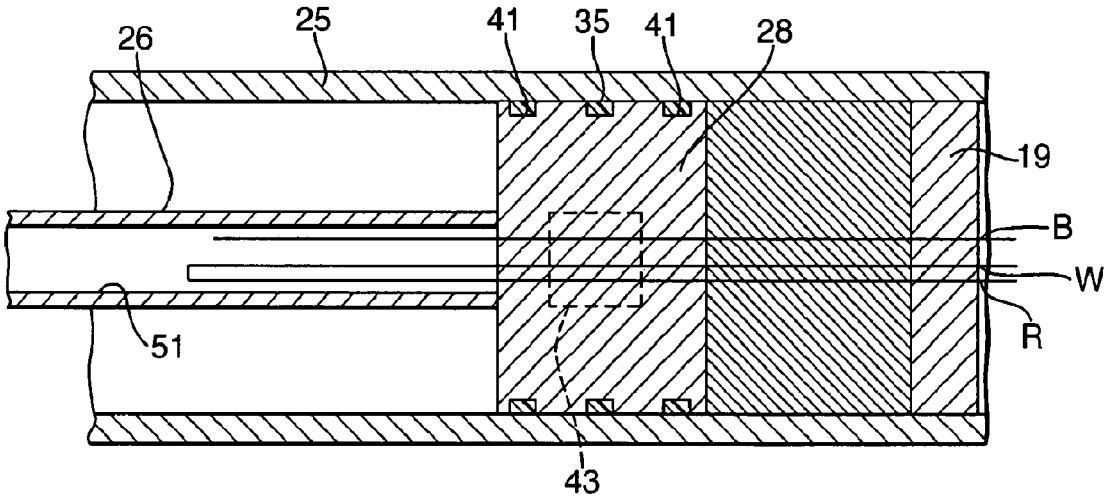
FIG. 2B is a schematic illustration of a sensor/transducer of an alternative exemplary embodiment of the present invention.
Figure 2B:
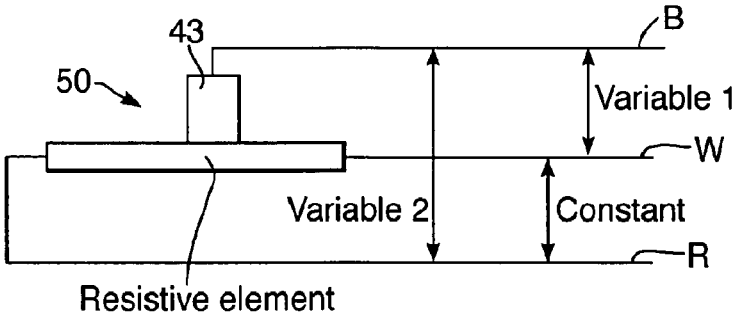

As is known in the related arts and as illustrated schematically in FIG. 2B a pot generally has three wires R, W, B or terminals. Two are simply the connections to the ends of the resistive element. The remaining terminal connects to a moveable contact called the wiper 43. The wiper slides along the surface of the resistive element as the rod is moved and in an exemplary embodiment, the wiper is conductive and provides a conductive path between the resistive element and a wire. As the wiper is moved closer to one end of the resistive element, the resistance between the wiper terminal and that end terminal decreases thus, a signal (e.g., voltage from a power source) indicative of the position of the rod is capable of being generated. In one non-limiting exemplary embodiment, the wiper is secured to the piston and as the same moves along the two other wires a signal indicative of the position of the rod is generated.

For example and in one exemplary embodiment, the rod 26 is configured to have a hollow chamber 51 in which the transducer/sensor is positioned such that movement of the rod will be tracked by the sensor and a signal is outputted to the control unit wherein the signal is indicative of the movement of the rod. In this exemplary embodiment, the piston is configured to have an opening 53, which allows the transducer to extend into the hollow chamber 51, the wires of the transducer to extend through opening 53 into the transition plate and ultimately to the control unit while the third or slider providing the electrical bridge is secured to the piston and/or interior of the rod and the position of the rod via the slider determines what percentage of an input voltage will be applied to the circuit of the sensor. Although opening 53 allows access to the hollow chamber 51 of the rod from chamber 44 it is understood that substantially no fluid passes directly from the first chamber to the second chamber through the rod and opening 53. Of course, other types of sensing devices may be employed. For example, one other non-limiting sensor is linear position sensor or linear variable differential transformer, or LVDT, wherein a series of inductors are positioned in a hollow cylindrical shaft and a solid cylindrical core is provided. As is known in the related arts a LVDT will produce an electrical output proportional to the position of the core. In one example, two secondary coils are placed symmetrically on either side of a primary coil contained within the hollow cylindrical shaft. Movement of the magnetic core causes the mutual inductance of each secondary coil to vary relative to the primary, and thus the relative voltage induced from the primary coil to the secondary coil will vary as well. Non-limiting examples of such a sensor may be found at http://www.macrosensors.com. In an exemplary embodiment, the core will be secured to the transition plate and the hollow shaft will vary the position of the coils with respect to the core.

In accordance with an exemplary embodiment the control unit will comprise a controller comprising a microcontroller, microprocessor, or other equivalent processing device capable of executing commands of computer readable data or program for executing a control algorithm. In order to perform the prescribed functions and desired processing, as well as the computations therefore (e.g., operating the motor and pump), the controller may include, but not be limited to, a processor(s), computer(s), memory, storage, register(s), timing, interrupt(s), communication interfaces, and input/output signal interfaces, as well as combinations comprising at least one of the foregoing. For example, the controller may include input signal filtering to enable accurate sampling and conversion or acquisitions of such signals from communications interfaces. As described above, exemplary embodiments of the present invention can be implemented through computer-implemented processes and apparatuses for practicing those processes.

In accordance with an exemplary embodiment of the present invention all of the sub-systems and components may be modulated and integrated as a single unit, which has a cylindrical housing of an extended linear configuration. The integration and assembly may vary based upon applications. For example, the hydraulic cylinder may comprise the flexible compensator, the first and second chambers, the transition plates, the control module, which is secured to a pump module and a motor module.

In accordance with an exemplary embodiment the elements are all designed and arranged in-line with the hydraulic cylinder so that a compact package, particularly compact in diameter, can be achieved. The compact in-line hydraulic system with optional modules may be assembled together within a tube-like housing.

Valve system 46 includes a plurality of fluid flow channels and ports among the pump, control units, and the flexible volume device. The valve system is designed so that channels and ports may be connected through the parallel surfaces. The selection of integrated-modulated hydraulic units may be optional and exchangeable based upon the application requirements.

The control modules or valve modules comprise various hydraulic valve(s), which may be designed and integrated into the control modules. The functions of the control valves and/or module(s) may include, but not limited to, a counterbalance module, a cross over relief module, and a pilot check module, etc. In accordance with an exemplary embodiment of the present invention it is also contemplated to use solenoid driven valve(s), and/or switch(es) in conjunction with the valve system.

In accordance with an exemplary embodiment, the self contained flexible volume device is pre-loaded or pre-pressurized to a predetermined pressure. The means to pre-load, or pre-pressure the flexible volume device include, but are not limited to, spring loading the compensator, an accumulator with compressed air, or a pressurized bladder made from rubber-like materials. In one exemplary embodiment, the bladder is a flexible rubber like material 55 (FIG. 4) and the bladder is inserted between the inner cylinder and the outer housing and a spring 57 is positioned to maintain a predetermined amount of pressure upon the bladder. In this embodiment no gas or air is found in the self contained flexible volume device. In addition and in accordance with exemplary embodiments of the present invention the hydraulic actuator is sealed and self contained so that no air or gas is found in the first chamber, the second chamber, the pump and the valve system or systems interconnecting each of the components thus in accordance with exemplary embodiments of the present invention only the self contained flexible volume device may have compressed air therein, which is provided only to maintain the fluid in the self contained flexible volume device at a predetermined positive pressure and this air does not escape into other portions of the actuator. Again and as mentioned above, other embodiments contemplate pressurizing the self contained flexible volume device wherein no gas or air is in the system at all other than perhaps an external pressure to a flexible compensator.

In accordance with an exemplary embodiment the hydraulic actuator has a self-contained flexible volume compensator. The self-contained flexible volume compensator balances the volume between the first chamber and the second chamber. In accordance with an exemplary embodiment the volume compensator is pre-loaded, or pre-pressurized by means of spring load, compressed air, which may be external or internal to the self-contained flexible volume compensator wherein a low positive pressure (e.g., approximately 100 psi) in the self-contained flexible volume compensator is provided to have selective fluid communication with at least one chamber being at a high pressure in order to facilitate movement of the piston and rod. In another alternative exemplary embodiment, the self-contained flexible volume compensator is a flexible bladder made from rubber-like materials, etc. In accordance with an exemplary embodiment the pressurized volume compensator is self-contained and not open to the atmosphere. In accordance with an exemplary embodiment of the present invention, the self-contained flexible volume compensator is pre-pressurized to a low pressure, which in one exemplary embodiment is less than 100 psi but greater that 1 atmosphere, although pressures greater or less than 100 psi are also contemplated and the active chamber or chamber (e.g., first chamber 42 or second chamber 44) forcing the movement of the piston is pressurized to a high pressure e.g., 300-3000 psi in order to facilitate the movement of the piston and rod within the chamber. In other words, the first and second chambers are and associated valves are configured for high pressures to facilitate movement while the self-contained flexible volume compensator is pre-pressurized to at least a low pressure respective to the high pressure chamber, which allows transfer of fluid into the self-contained flexible volume compensator as well as transfer of fluid out of the self-contained flexible volume compensator.

Accordingly, and as the actuator is operated the pressurized volume compensator will push fluid out of the volume compensator into the pump when the cylinder and rod is extending and the fluid will be pumped back into the volume compensator when the cylinder and rod is retracted regardless of the location and/or orientation of the volume compensator since it is pre-pressurized and self-sealed. Accordingly, the self-contained flexible volume compensator may be located anywhere between modules, such as between the cylinder and valves, or between the valves and pump module. It can also be located between an inner housing defining the first chamber and the second chamber and the outer housing the inner housing is located in. In accordance with an exemplary embodiment the volume compensator can also function as an accumulator with ability to provide an output as self-assistance to the actuation of the device. In accordance with an exemplary embodiment the self-contained flexible volume compensator can be installed and operated in any orientation.

In accordance with an exemplary embodiment of the present invention the valve system has a plurality of valves for providing selective fluid communication among the chambers, the pump, and the self-contained flexible volume compensator. The valve system and the hydraulic actuator will operate in numerous modes, manual extraction, manual retraction, powered extraction, powered retraction and lock out.

In accordance with an exemplary embodiment of the present invention, the closed hydraulic cylinder comprises a piston, a plurality of flow channels, an outer tube or housing, a movable inner tube as an output rod, an optional position or pressure sensor system positioned within the output rod, a pair of end caps (e.g., a top cap, a base cap, and seals). In accordance with an exemplary embodiment a flow channel may be located between the inner and outer tubes positioned between the top and base caps the flow channel will connect the upper chamber and an inlet channel. The movable tube may also be an optional inner flow channel, or as a housing for the optional position sensor system. There may be a stabilizing device, wherein the stable device or wear ring prevents the piston from rotating or twisting as the piston moves within the cylinder. In this embodiment, stable device or wear ring between the piston and the inner wall provides piston with smooth movement and prevents inaccuracies in the optional sensor system. The top cap will have an opening for the output rod. The base cap will have ports which connect with additional modulated hydraulic units. The modulated hydraulic units comprising the pump and motor modules may be attached to the base cap in sequence. The self-contained flexible volume device may be located anywhere between modules, such as between the cylinder and valves, or between the valves and pump module.

Figure 4:
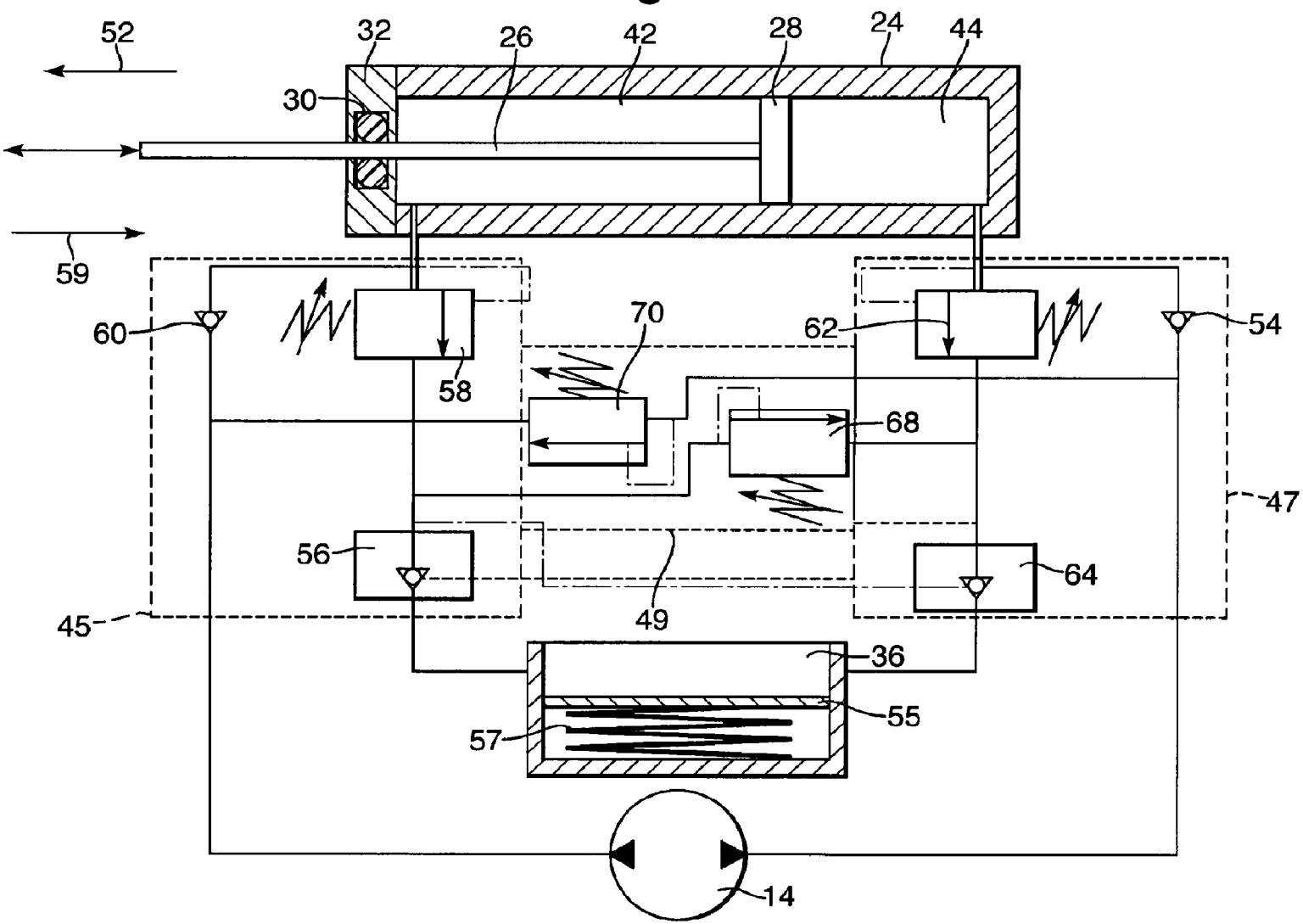
FIG. 4 is a schematic illustration of a hydraulic actuator and control scheme in accordance with an exemplary embodiment of the present invention.

Referring now to FIG. 4 and when it is desirable to have the rod extend out of the cylinder in the direction of arrow 52, the pump is pressurizing the right side or the second chamber 44 of the cylinder. During this operation the bidirectional pump 14 causes the pressurized fluid to flow through a top check valve 54 at the right of FIG. 4 allowing fluid to enter the right side chamber. This fluid pressure also opens a bottom pilot check valve 56, which allows extra fluid flow out of the volume compensator 36 into the pump. Note: FIG. 4 shows the self contained flexible volume compensator as being pre-pressurized by for example a spring biasing means 57 thus, no air is in the compensator or system. Also, the self contained flexible volume compensator may be located anywhere with the hydraulic actuator.

The moving piston in the direction of arrow 52 increases the fluid pressure within the left side chamber until it reaches the setting point of a counterbalance valve 58. Counterbalance valve 58 then opens and the fluid flows out of the left side chamber or the first chamber through counterbalance valve 58 and into the pump.

During retraction and when it is desirable to have the rod retract into the cylinder in the direction of arrow 59, the pump is pressurizing the left side or the first chamber of the cylinder. During this operation the pressurized fluid flows through a check valve 60 and enters the left side or the first chamber. The moving piston increases the fluid pressure within the right side chamber or the second chamber until it reaches the setting point of a counterbalance valve 62. The counterbalance valve 62 then opens and the fluid flows out of the right side chamber through it and into the pump. The pumping fluid pressure at the left side also opens a bottom pilot check valve 64, which allows the extra fluid out of the right side chamber or second chamber 44 to flow into the volume compensator as well as it is not necessary for movement of the rod and piston in the direction of arrow 59.

In accordance with an exemplary embodiment of the present invention and since the fluid system exclusive of the compensator in some alternative embodiments does not have any compressible air in it there will always be two independent sources of fluid for the second chamber 44. Since there is no rod disposed in chamber 44 and since the fluid is not compressible a greater amount or volume of fluid is required to cause chamber 44 to be an active side of the actuator. Accordingly, a greater amount of fluid is required to move the rod and piston on the direction of arrow 52. Thus and during this operation (e.g., in the direction of arrow 52) fluid flows from the pump into the second chamber 44 wherein the pump is supplied with fluid from both the compensator 36 and the first chamber 42.

In contrast and when the rod is actuated in the direction of arrow 59 by reversing the pump, the pilot check valve 64 opens and the excessive fluid will flow back into the compensator as the extra fluid from the second chamber is not necessary due to the reduced volume caused by the presence of the rod in chamber 42. In other words moving the piston all the way to end plate 32 will create a greater volume in chamber 44 than a volume created in chamber 42 when the piston is moved all the way to the opposite plate again due to the presence of the rod in the chamber thus, the self-contained flexible volume device or compensator 36 compensates for the need of extra fluid in one operation and lack thereof in another operation. Along these lines and in yet another alternative exemplary embodiment, pilot check valve 56 may be replaced with a one way check valve as long as the sucking pressure of the pump will open the valve since only flow out of the compensator for actuating the rod in the direction of arrow 52 may be required while two way flow is required from valve 64 as the rod moves in the directions of arrows 52 and 59.

During a hold request or position when the cylinder, rod, and piston need to stop and hold in any position when the pump stops and fluid is not pressurized without any flow, all check valves and counterbalance valves will close. In this configuration the chambers within the cylinder are disconnected and fluid cannot flow out or into the chambers through valves. The system, thus, is self-locked.

During a manual operation and when the cylinder, rod, and piston need to be extended manually (e.g., when the pump stops) the moving piston increases the fluid pressure within the left side chamber or the first chamber until it reaches the setting point of the counterbalance valve 58. Then the counterbalance valve 58 opens and the fluid flows out of the left side chamber through the counterbalance valve 58 and then the pressure also opens a middle crossover check valve 68 comprising a portion of a cross over relief module 49, which in accordance with an exemplary embodiment of the present invention provides at least two functions 1) a bypass relief when the piston has completely traveled to one side of the chamber and the pump is still pressurizing the active chamber and 2) a manual bypass or override when the rod is being manipulated manually and the pump is not activated or inoperative. The fluid then flows through the middle crossover check valve 68 and the check valve 54 into the right side chamber. The pressure also opens the pilot check valve 56, which allows the extra fluid flows out of the volume compensator into the right side chamber. During this manual operation the pressurized fluid of the self contained flexible volume compensator will assist in the extraction.

When the cylinder, rod, and piston need to be retracted manually (e.g., when the pump stops due to operational failure or not power or during manual operation) the moving piston increases the fluid pressure within the right side chamber or second chamber until it reaches the setting point of the counterbalance valve 62. The counterbalance valve 62 then opens and the fluid flows out of the right side chamber through it and then the pressure also opens a middle crossover check valve 70 to open. The fluid then flows through the middle crossover check valve 70 and the valve 60 into the left side chamber. The pressure also opens the pilot check valve 64, which allows the extra fluid flows into the volume compensator from the right side chamber or second chamber.

As discussed above and as illustrated in FIGS. 1 and 3 and in alternative exemplary embodiments of the present invention, the system has an optional position sensor, which can be located at the side of the cylinder, middle of the cylinder, side or center of the rod. In this embodiment, the system may be programmable to stop and start at any position within the operation range if required and based upon the sensor output. In addition, the system may be programmable to a desirable speed profile within the operation range if required. In yet another alternative exemplary embodiment, the system may be programmable for a manual-to-power-start feature within the operation range if required. In other words when the actuator is manipulated manually and the sensor detects movement a signal is sent to the controller to activate the motor and provide powered retraction and/or extraction of the rod.

Figure 5:
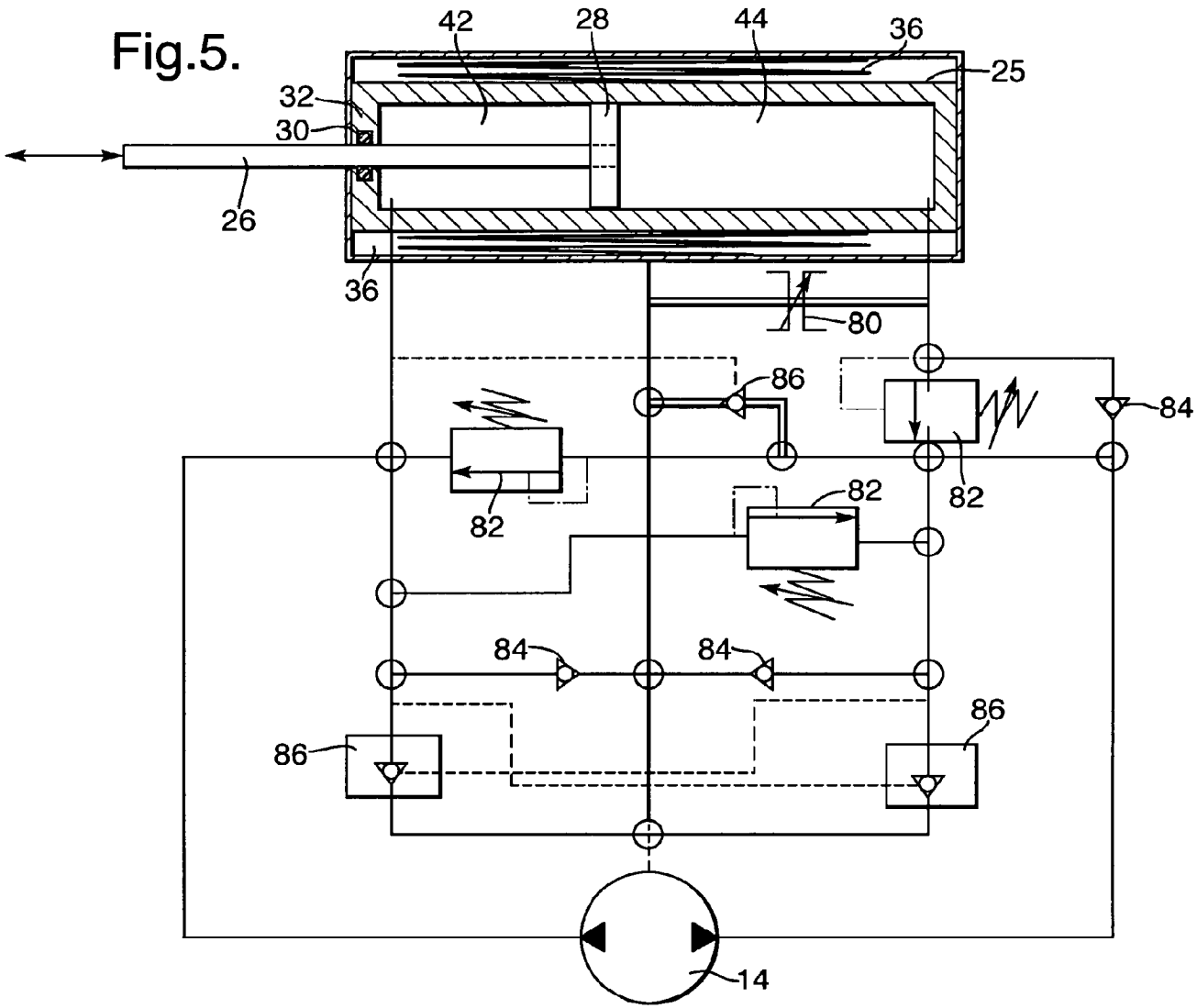
FIG. 5 is a schematic illustration of a hydraulic actuator and control scheme in accordance with another exemplary embodiment of the present invention.

Referring now to FIG. 5 another control scheme of an exemplary embodiment of the present invention is illustrated. Here the self-contained flexible volume compensator is shown disposed around the housing defining the first and second chambers. In this embodiment, a bypass valve 80 as an override (bypass) feature for emergency operation when power fails, or service operation as required. When power failure occurs, the bypass valve can be opened, manually or by system setting and the chambers within the cylinder and the self-contained volume compensator are connected and fluid can flow through valves when driven manually. The system, thus, can be driven manually. In this embodiment, the valve system also comprises a plurality of counterbalance valves 82, check valves 84 and pilot check valves 86.

Figure 6:
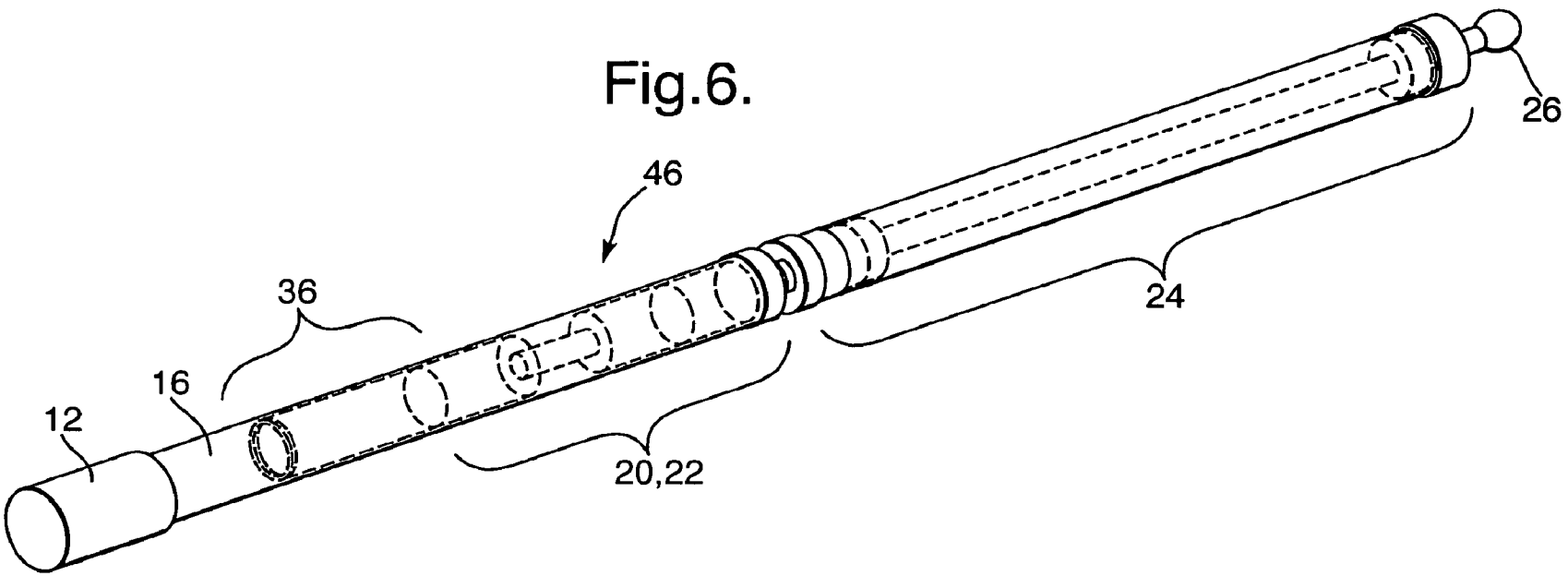
FIG. 6 is a perspective view of a compact actuator constructed in accordance with an exemplary embodiment of the present invention.
Figure 7:
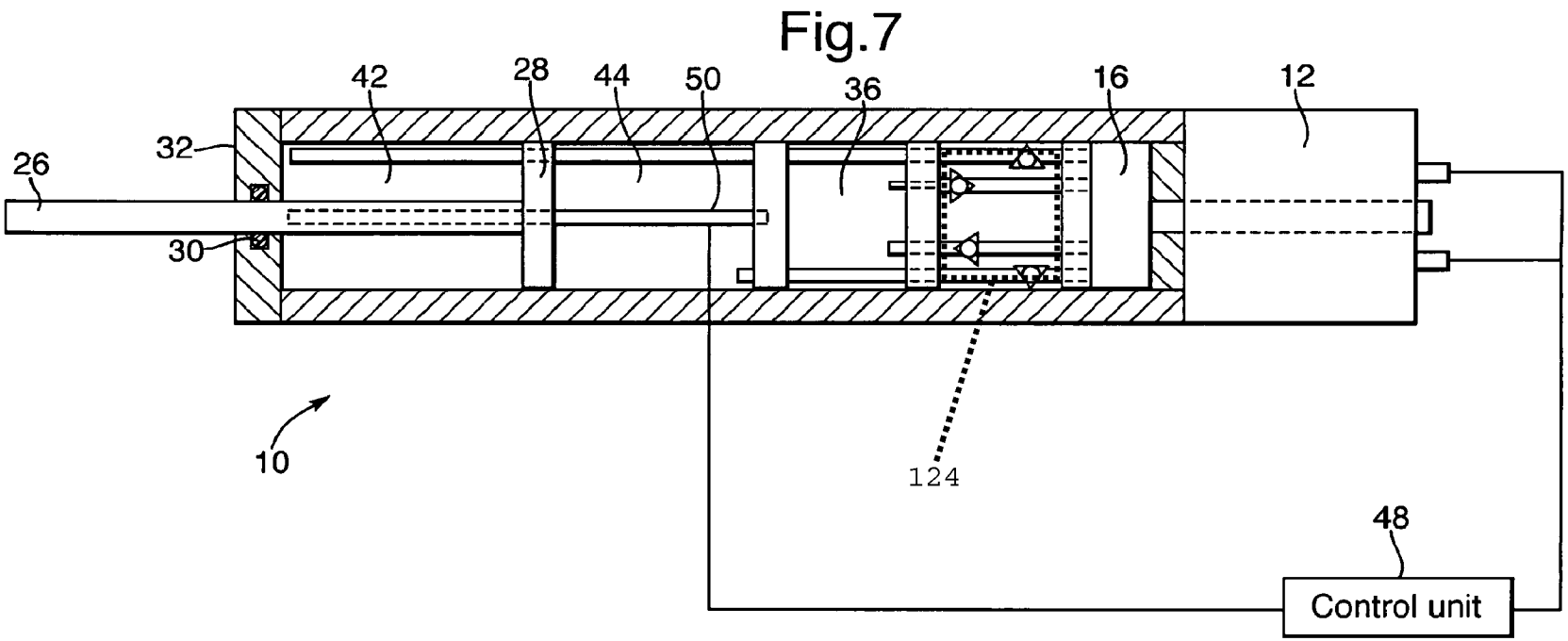
FIG. 7 is a cross sectional schematic view of a hydraulic actuator constructed in accordance with another exemplary embodiment of the present invention.
Figure 8:
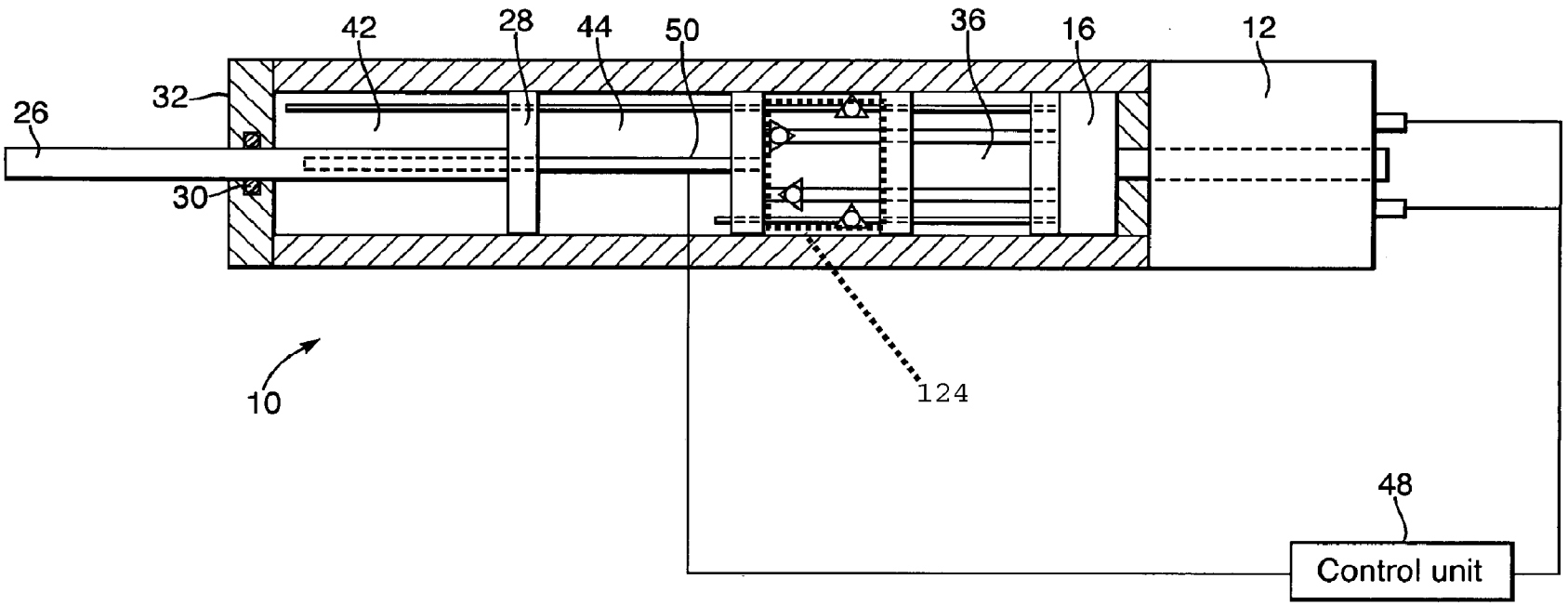
FIG. 8 is a cross sectional schematic view of a hydraulic actuator constructed in accordance with yet another exemplary embodiment of the present invention.
Figure 9:
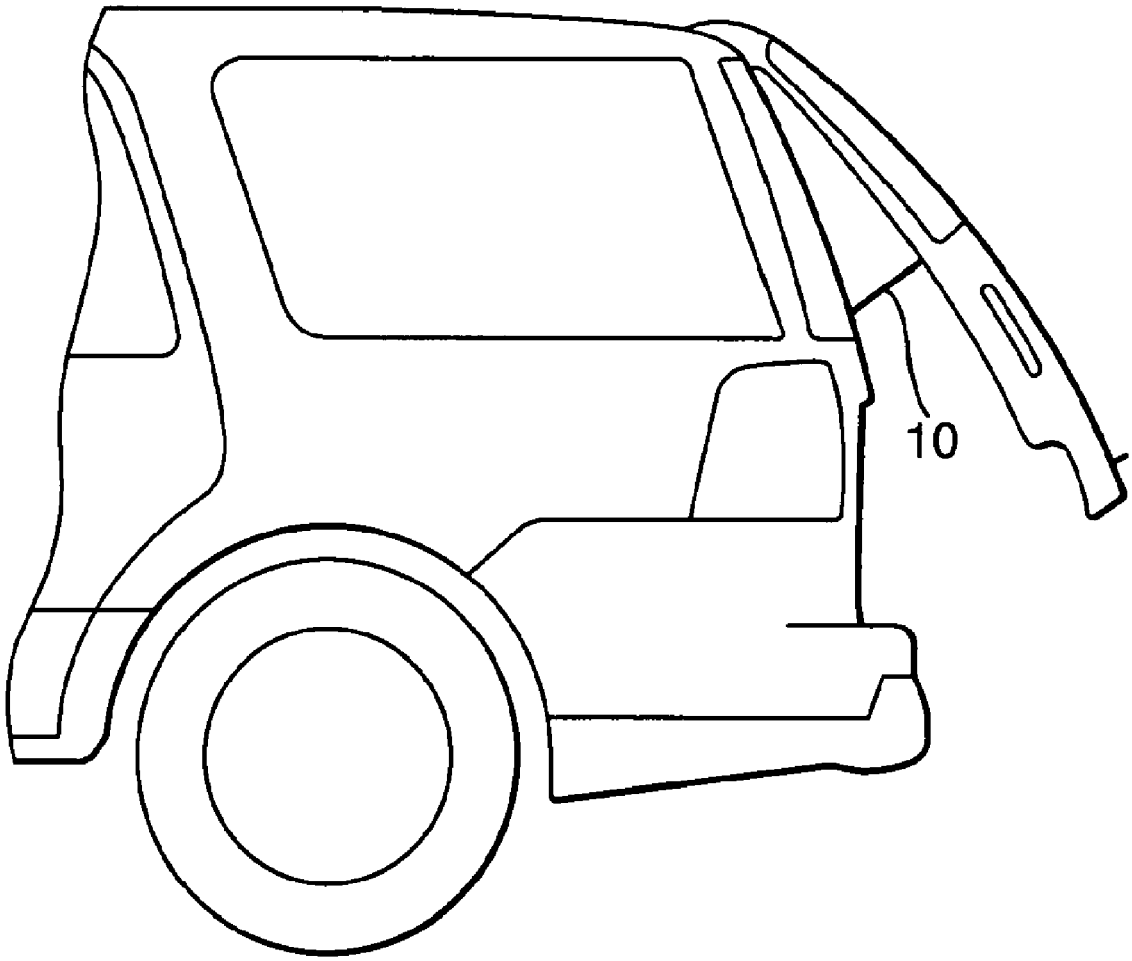
FIG. 9 illustrates the hydraulic actuator in a vehicle.

FIGS. 6-8 illustrate alternative configurations wherein the self-contained flexible volume compensator is located in various positions within the housing. FIG. 9 illustrates a vehicle lift gate being operated by a hydraulic actuator in accordance with an exemplary embodiment of the present invention. In accordance with an exemplary embodiment of the present invention the hydraulic actuator may be secured between a door and body of a vehicle in two ways, either the rod is secured to the door and the motor housing end is secured to the body of the vehicle, or the rod is secured to the body and the motor housing end is secured to the door of the vehicle.

Figure 10:
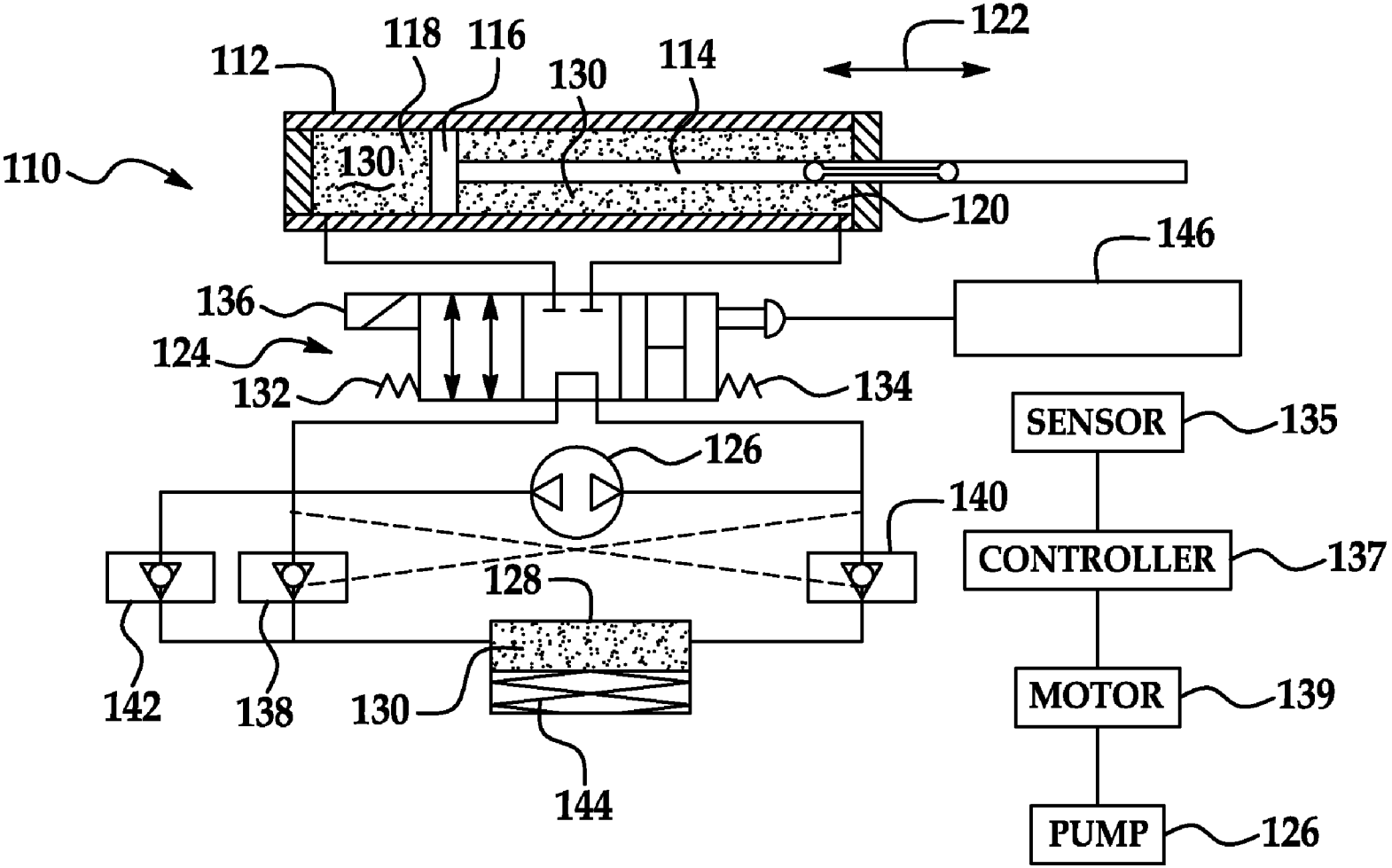
FIG. 10 illustrates one non-limiting example of an exemplary embodiment of the present invention.

Referring now to FIG. 10 a schematic illustration of a control scheme for a dual-mode hydraulic actuator 110 is illustrated. In accordance with an exemplary embodiment of the present invention, the dual-mode hydraulic actuator is configured for both power and manual operations wherein an open flow position is provided. As illustrated, hydraulic actuator 110 comprises a housing 112. Housing 112 is configured to slidably receive a rod 114 secured to a piston 116. On either side of piston 116 is a chamber 118, 120 each of which receives fluid for manipulating piston 116 in the direction of arrows 122. Rod 114 is secured to an item to be moved for example, a lift gate of a vehicle.

In order to provide fluid communication between chambers 118 and 120, a bi-mode control valve or solenoid driven valve 124 provides selective fluid communication with chambers 118 and 120 as well as a bidirectional pump 126 and a sealed reservoir 128. Sealed reservoir contains a fluid 130 under pressure so that the reservoir and the dual-mode actuator of exemplary embodiments of the present invention is not adversely affected by gravity should the orientation of the actuator vary. As shown, bi-mode control valve 124 is biased into a neutral position by for example, a pair of springs 132, 134 that are disposed on either side of the control module. Of course, any other type of biasing means may be employed to bias the valve into the neutral position. In addition, and in order to provide a powered mode of operation (FIGS. 11A and 11B) a solenoid 136 is positioned to manipulate the bi-mode control valve from a neutral position (FIG. 10) to a powered up or a powered down position (FIGS. 11A and 11B) wherein the bi-mode control valve is in an open flow position and fluid can flow through the valve.

In addition, the dual-mode hydraulic actuator has a pair of pilot check valves 138 and 140 (e.g., spring or otherwise biased) as well as a check valve 142. Alternatively, the pair of pilot check valves 138 and 140 as well as check valve 142 are included in bi-mode control valve 124 as a single unit. For example and as illustrated in FIGS. 1-3, 7 and 8 reference numeral 124 may designate the bi-mode control valve with or without the pair of pilot check valves 138 and 140 and check valve 142. If designated without valves 138, 140 and 142 it is understood that the valves are in close proximity to bi-mode control valve and the same are in fluid communication with the bi-mode control valve and the chambers and the sealed reservoir. In a non-limiting exemplary embodiment valve module 20 is a dual mode valve module comprising bi-mode control valve 24 (illustrated schematically in FIGS. 10-11D), which may be integral with valves 138, 140 and 142 or valves 138, 140 and 142 may be in dual mode valve module 20 or in close proximity (e.g., valve module 22). Accordingly, the schematic representation of bi-mode control valve 124 in FIGS. 1-3, 7 and 8 illustrate the bi-mode control valve in the valve module making them dual mode valve modules.

In addition and referring back now to FIGS. 10-11B, the sealed reservoir 128 also comprises a means 144 (e.g., spring or other equivalent means) for maintaining fluid 130 under pressure.

When required, the bypass valve can be opened manually or by a solenoid or system setting to provide an open flow position wherein fluid flow though the valve is provided. The manual opening may be required due to power failure, service needs, or an impatient operator who pushes the door open. For example, and as illustrated schematically, the bi mode control valve or solenoid valve is coupled to a movable item 146 (e.g., a vehicle lift gate, a cable coupled to the lift gate, a handle, a push button) such that movement of the same will cause the bi mode control valve or solenoid valve to move from the neutral position to either the manual up position or the manual down position wherein the spring biasing force of spring 132 and/or 134 is/are overcome and an open flow position of the valve is provided. Here the fluid flow and open flow position of the manual mode of the bi-mode control valve is illustrated in FIGS. 11C and 11D.

In another alternative exemplary embodiment, the bi mode control valve or solenoid valve when manipulated into the manual up or manual down mode can provide a signal to the pump in order to provide a supplemental pumping force to the fluids traveling through the system. The signal in one exemplary embodiment can be provided by a sensor 135 configured to detect movement of item 146, wherein sensor 135 provides a signal to a controller 137, which upon receipt of the appropriate signal will activate a motor 139 for pump 126 thus, during manual operation and when the pump and/or motor is in operation the system will be powered up to assist in the retraction or extension of rod 114. Alternatively, sensor 135 is positioned to detect movement of the rod. A non-limiting example of such a sensing device is illustrated in FIGS. 2A-2B. Accordingly, the sensor may be positioned to track movement of the rod or alternatively the item secured to the rod (e.g., a vehicle lift gate or a vehicle door, etc.) or another item such as a cable coupled to the lift gate, a handle, a push button, etc. or alternatively both the rod and the item or items.

In accordance with an exemplary embodiment the controller 137 will comprise a microcontroller, microprocessor, or other equivalent processing device capable of executing commands of computer readable data or program for executing a control algorithm. In order to perform the prescribed functions and desired processing, as well as the computations therefore (e.g., operating the motor and pump), the controller may include, but not be limited to, a processor(s), computer (s), memory, storage, register(s), timing, interrupt(s), communication interfaces, and input/output signal interfaces, as well as combinations comprising at least one of the foregoing.

Figure 11B:
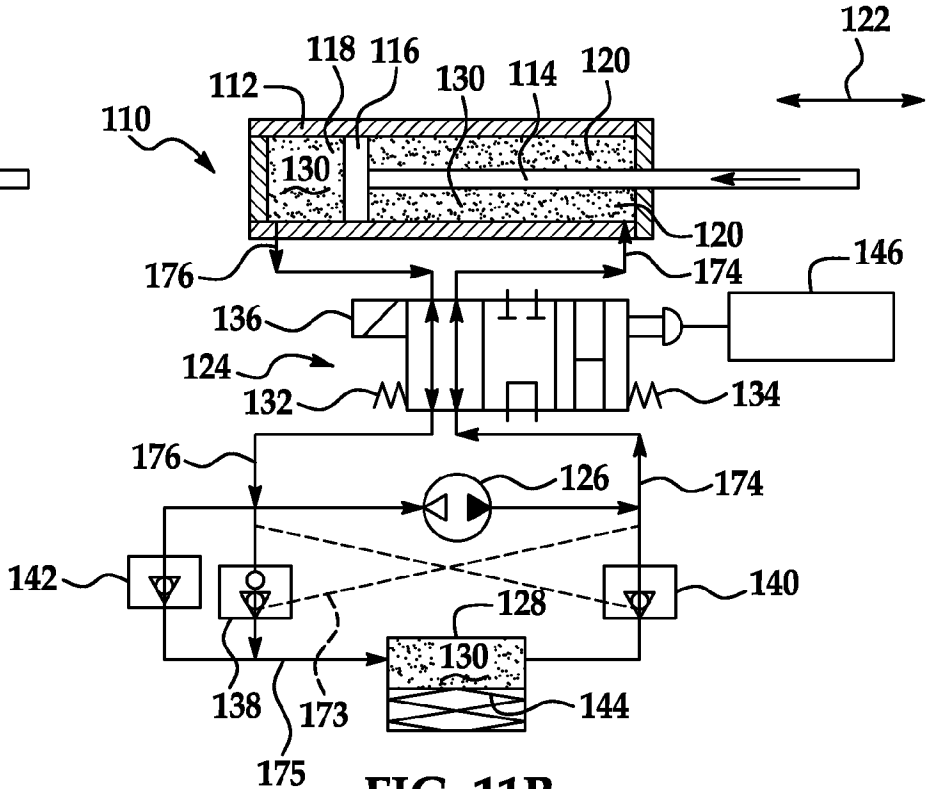
FIGS. 11A-11B illustrate power modes of a dual mode hydraulic system of an exemplary embodiment of the present invention.
Figure 11A:
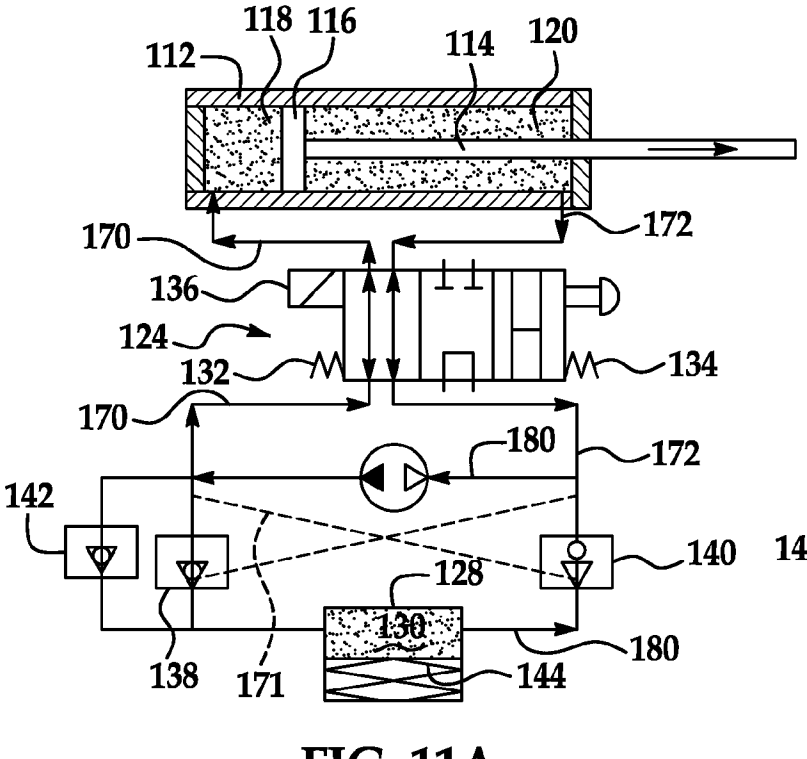
Figure 11D:
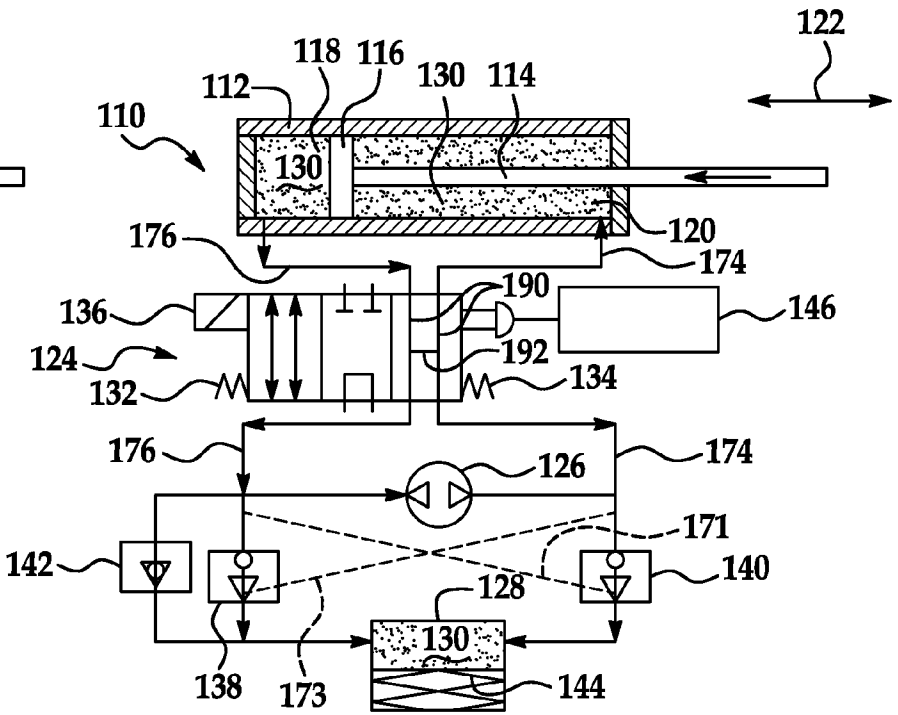
FIGS. 11C and 11D illustrate manual modes of a dual mode hydraulic system of an exemplary embodiment of the present invention.
Figure 11C:
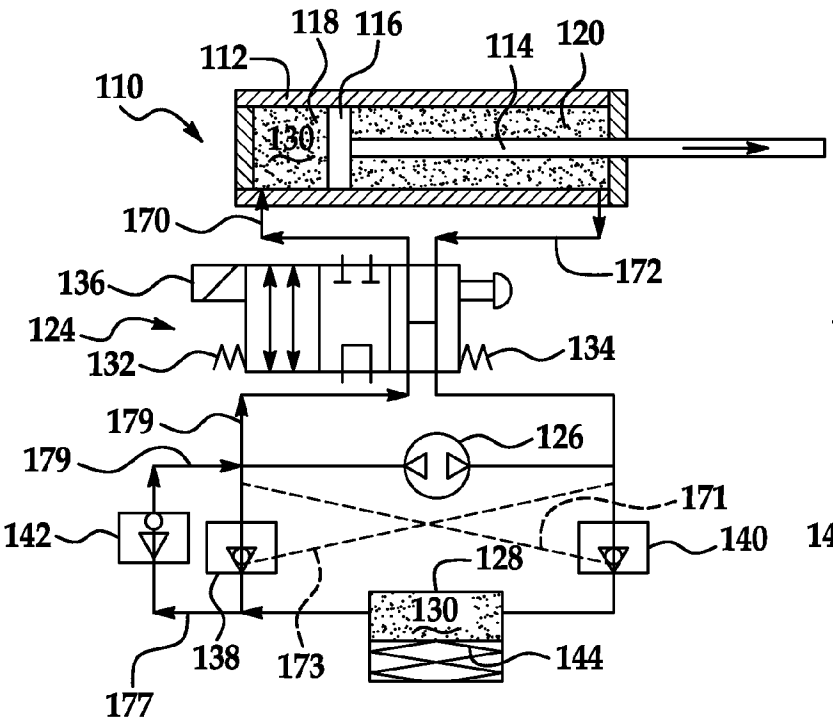

Referring now to FIGS. 11A-11D, schematic illustrations of powered and non-powered modes of the dual-mode hydraulic system is provided. FIGS. 11A and 11B illustrate a power operation of the dual-mode control hydraulic system and FIGS. 11C and 11D illustrate manual operation of the dual-mode hydraulic system.

Referring now to FIG. 10, the system will be controlled under power and/or manual operation as follows when the cylinder, rod, and piston need to stop and hold a movable item in any position when the pump is not operating and the fluid is not pressurized without any fluid flow. Here all the check valves are closed and the solenoid valve or bi mode control valve is in neutral position wherein no fluid flow is allowed through the bi-mode control valve. Accordingly, the chambers within the cylinder are disconnected and fluid cannot flow out or into the chambers through valves. The system is thus self-locked.

Referring now to FIGS. 11A and 11B, the system will be operated under power as follows: when the rod needs to extend out of the cylinder, the pump is pressurizing the left side of the cylinder (FIG. 11A). As illustrated, the pressurized fluid flows through the solenoid valve into the left side chamber. This fluid flow is illustrated by arrows 170 and as the fluid flows out of chamber 120 illustrated by arrows 172 and the fluid pressure (via line or conduit 171) also opens the pilot check valve 140 at the right, which is illustrated in an open flow position and allows extra fluid to flow out of the volume compensator 128 into the pump via arrows 180, which represent fluid flow and conduits for facilitating fluid flow. The extra fluid being required due to the fact that the rod is not in the left chamber thus more fluid is required to increase the pressure in chamber 118 as the fluid flowing out from chamber 120 is not enough to fill the chamber 118 in order to move piston 116 to the right since the rod 114 will not require as much fluid to move the piston to the left (e.g., during retraction). As shown herein arrows 170, 171, 172 and 180 schematically represent fluid conduits as well as the direction of fluid flow. Also, pump 126 is shown pumping fluid into chamber 118. Here the solenoid manipulates the bi-mode control valve into an open position (illustrated in FIGS. 11A and 11B wherein fluid flow through the bi-mode control valve is permitted) by overcoming the biasing force of springs 132 and 134.

In order to power down or retract the rod (FIG. 11B), the pump increases the fluid pressure within the right side chamber and the fluid flows out of the left side chamber and into the pump and the reservoir (arrows 174 and 176). As shown herein arrows 174 and 176 schematically represent fluid conduits as well as the direction of fluid flow. When the rod is required to retract into the cylinder of the housing, the pump is pressurizing the right side of the cylinder. During this operation, the pressurized fluid flows through the solenoid valve or bi-mode control valve into the right side chamber of the housing through the pump and the fluid pressure also opens the pilot check valve 138 (via line or conduit 173), which is shown in an open flow position and allows the extra fluid from the left chamber 118 to flow into the volume compensator as long as the required amount is provided to the pump. Here pump 126 is shown pumping fluid into chamber 120. This fluid flow is illustrated by arrows 175, which represent fluid flow and conduits for fluid flow into the volume compensator from valve 138.

Again, since the rod is in the right chamber 120 less fluid is required to move the piston to the left thus, the extra fluid required for extraction of the rod is now received into the compensation chamber since not all of the fluid is required to retract the piston.

Once the solenoid is de-energized the bi-mode control valve is manipulated back into the neutral or non-fluid flow position by springs 132 and 134 or any other equivalent biasing means.

Referring now to FIGS. 11C and 11D, a manual operation of the hydraulic actuator is illustrated. As illustrated, the rod and piston can be retracted and extracted manually when the pump is not operating or inoperable. During manual operation, the bi mode control valve or solenoid valve will be moved to a manual mode position, which connects both chambers. As illustrated in FIG. 11C during manual extraction, the piston increases the fluid pressure within the right side chamber 120 and arrows 170 and 172 illustrate conduits and fluid flow from chamber 120 to chamber 118 though bi-mode control valve 124 via conduits in the valve as well as other conduits. In addition, the system pressure opens check valve 142, which is illustrated in the open position and additional fluid can flow out of the compensator into the left side of chamber (e.g., chamber 118). This fluid flow is illustrated by arrows 177 and 179 which represent fluid flow direction and the conduits through which the fluid flows.

As illustrated in FIG. 11D during manual retraction, the piston increases the fluid pressure within the left side chamber 118 and arrows 176 and 174 illustrate conduits and fluid flow from chamber 118 to chamber 120 though bi mode control valve 124. In addition, the system pressure opens either pilot check valves 138 or 140 (via lines 171 or 173) or both valves 138 and 140 wherein the additional fluid can flow out of the left side chamber 118 into the flexible compensator from the left side chamber from the manual portion of the bi-mode control valve since both conduits 190 are in fluid communication with each other via a conduit 192. When the manual operation is completed, the bi mode control valve or solenoid valve is biased back to the neutral position via the springs and the system is locked.

During manual operation and when the rod and piston need to be extended manually with the pump being inoperable the solenoid valve will be moved to manual position, which connects the both chambers. This movement of the bi mode control valve or solenoid valve is caused by movement of an item secured to the bi mode control valve or solenoid valve and in the manual up operation the piston increases the fluid pressure within the right side chamber and forces the fluid to flow into the left side. Due to the volume differences between the two chambers (e.g., the displacement of fluid due to the rod), the whole system pressure reduces, the check valve 142 opens and fluid can flow out the volume compensator into the left side of chamber.

When the manual operation either up (extracted) or down (retracted) is completed, the bi mode control valve or solenoid valve will move back into the neutral position to lock the system.

In accordance with exemplary embodiments of the present invention, the bi mode control valve or solenoid valve 124 is contemplated for use with any of the embodiments illustrated herein for example and referring now to FIGS. 1-3 bi-mode control valve 124 is incorporated into valve member 20 thus making the same a dual mode valve member. Similarly and referring to FIGS. 3, 7 and 8 the bi-mode control valve or solenoid valve 124 is illustrated schematically by the dashed lines wherein appropriate fluid communication is provided by fluid conduits and valves. In accordance with exemplary embodiments of the present invention, the embodiments illustrated of FIGS. 1-9, where applicable, are incorporated with bi-mode control valve 124.

In one exemplary embodiment of the present invention, the system has modulated hydraulic control units (valves), a pump and a motor module, and a self-contained flexible volume device. The system may be assembled in sequence as a compact hydraulic system. In another exemplary embodiment, the system has a self-contained flexible volume device or module, wherein this device can balance the volume difference between the chambers during manual or powered mode. This device may be pre-loaded, or pre-pressurized by means of spring load, compressed air, or a flexible bladder made from rubber-like materials or equivalents thereof.

In accordance with exemplary embodiments, the self-contained flexible volume device may be located anywhere between the modules, such as between the cylinder and valves, or between the valves and the pump module. In another exemplary embodiment, the self-contained flexible volume can also be located between the inner and the outer tubes.

In accordance with exemplary embodiments, the pre-loaded or pre-pressurized flexible volume device of the system functions as an accumulator that has an ability to provide an output of self-assistance to actuation of the hydraulic actuator.

In accordance with one exemplary embodiment of the present invention, the system has a bypass valve with an override (bypass) feature for emergency operation when power fails.

In yet another exemplary embodiment of the present invention, the system has an optional position sensor, wherein the system the pump of the system may be programmable to stop and start in accordance with any position of either the rod or the item being manipulated by the rod wherein the movement of the rod and/or the item being moved is tracked by a sensor.

In accordance with an exemplary embodiment, the system with an optional position sensor may be programmable with a manual-to-power-start feature. In other words, manual movement of the actuator causes a powered operation of the system or powered assist operation of the system.

In accordance with another exemplary embodiment, the modular compact hydraulic system can output force and motion simultaneously, or can output force only per application requirements. In one exemplary embodiment, the modular compact hydraulic system is used as an actuator for automotive applications, such as driving a side door, tail gate, sliding door, deck lit, etc.

In other exemplary embodiments, the modular compact hydraulic system is used as a driving device for many other industrial fields where a compact in-line actuator system is desired, such as medical machines, health and sport training machines, assembly stations or lines, testing machines, lifting or actuating units in aerospace industries, etc.

In another exemplary embodiment, the modular compact hydraulic system is controlled by a dual operational module which consists of an integrated solenoid driven valve and three pilot check valves.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

What is claimed is:

1. A dual mode hydraulic actuator, comprising:

a housing;

a rod secured to a piston, the rod and piston being slidably received within the housing;

a first chamber positioned on one side of the piston and within the housing;

a second chamber positioned on another side of the piston and within the housing;

a sealed reservoir disposed within the housing;

a fluid disposed in the first chamber, the second chamber and the reservoir;

a bidirectional pump for moving the fluid between the first chamber, the second chamber and the sealed reservoir;

a bi-mode control valve for providing selective fluid communication between the first chamber, the second chamber and the sealed reservoir, the bi-mode control valve being biased into a neutral position wherein fluid communication between the first chamber, the second chamber and the sealed reservoir is prevented and the bi-mode control valve being capable of being manually manipulated into an open flow position wherein fluid flow from the first chamber to the second chamber is provided and fluid flow from or to the sealed reservoir is also provided, the fluid flow from or to the sealed reservoir being dependant upon a volume of fluid in the first chamber and the second chamber.

2. The dual mode hydraulic actuator as in claim 1, wherein the sealed reservoir contains a portion of the fluid and the portion of the fluid therein is maintained under pressure.

3. The dual mode hydraulic actuator as in claim 1, wherein the bi-mode control valve is biased into the neutral position by a pair of springs disposed on either side of the bi-mode control valve.

4. The dual mode hydraulic actuator as in claim 1, wherein the bi-mode control valve is in operable communication with an item for manipulating the bi-mode control valve from the neutral position.

5. The dual mode hydraulic actuator as in claim 1, wherein the bi-mode control valve further comprises a solenoid for manipulating the bi-mode control valve into an open flow position, wherein fluid flow from the first chamber to the second chamber is provided and fluid flow from or to the sealed reservoir is also provided.

6. The dual mode hydraulic actuator as in claim 1, wherein actuator is secured to a lift gate of a vehicle.

7. The dual mode hydraulic actuator as in claim 1, wherein the bi-mode control valve further comprises a solenoid for manipulating the bi-mode control valve into an open flow position, wherein fluid flow from the first chamber to the second chamber is provided and fluid flow from or to the sealed reservoir is also provided when the bi-directional pump is operated.

8. The dual mode hydraulic actuator as in claim 7, wherein the bi-mode control valve further comprises at least one valve and at least a pair of pilot check valves for providing fluid communication between the bidirectional pump and the sealed reservoir when the solenoid manipulates the bi-mode control valve into the open flow position.

9. The dual mode hydraulic actuator as in claim 1, wherein the bi-mode control valve further comprises at least one check valve and at least a pair of pilot check valves for providing fluid communication between the sealed reservoir and the first and second chambers when the bi-mode control valve is manually manipulated into an open flow position.

10. A dual mode hydraulic actuator, comprising:

a housing;

a rod secured to a piston, the rod and piston being slidably received within the housing, wherein the rod along with the piston is capable of movement between a first position and a second position;

a first chamber positioned on one side of the piston and within the housing;

a second chamber positioned on another side of the piston and within the housing;

a self contained flexible volume compensator disposed within the housing;

a fluid disposed in the first chamber, the second chamber and the self contained flexible volume compensator, wherein the fluid in the self contained flexible volume compensator is pressurized to a predetermined pressure level;

a bidirectional pump for moving the fluid between the first chamber, the second chamber and the self contained flexible volume compensator;

a bi-mode control valve disposed in the housing and for providing selective fluid communication between the first chamber, the second chamber, the bidirectional pump and the self contained flexible volume compensator as the rod moves in a range of movement defined by the first position and the second position, wherein the bi-mode control valve isolates the first chamber from the self contained flexible volume compensator and the second chamber when a fluid pressure in at least one of the first chamber, the second chamber and the self contained flexible volume compensator is below a predetermined level and the pressurized fluid in the self contained flexible volume compensator is transferred from the self contained flexible volume compensator to the second chamber via the pump during a powered mode of operation through the bi-mode control valve or through the bi-mode control valve during a manual mode of operation.

11. The dual mode hydraulic actuator as in claim 10, wherein the bi-mode control valve is biased into a neutral position by a pair of springs disposed on either side of the bi-mode control valve, wherein the bi-mode control valve isolates the first chamber from the self contained flexible volume compensator and the second chamber when a fluid pressure in at least one of the first chamber, the second chamber and the self contained flexible volume compensator is below a predetermined level.

12. The dual mode hydraulic actuator as in claim 10, wherein the bi-mode control valve is in operable communication with an item for manipulating the bi-mode control valve from the neutral position to an open flow position wherein fluid flow through the bi-mode control valve is permitted and fluid flows between the first chamber and the second chamber and to or from the self contained flexible volume compensator.

13. The dual mode hydraulic actuator as in claim 10, wherein the bi-mode control valve further comprises a solenoid for manipulating the bi-mode control valve into an open flow position wherein fluid flow through the bi-mode control valve is permitted and fluid flows between the first chamber and the second chamber and to or from the self contained flexible volume compensator.

14. The dual mode hydraulic actuator as in claim 10, wherein the bi-mode control valve further comprises at least one check valve and at least a pair of spring biased pilot check valves for providing fluid communication between the bidirectional pump and the sealed reservoir during the powered mode of operation.

15. The dual mode hydraulic actuator as in claim 10, wherein the bi-mode control valve further comprises at least one check valve and at least a pair of pilot check valves for providing fluid communication between the sealed reservoir and the first and second chambers when the bi-mode control valve is manually manipulated into an open flow position, wherein the fluid flow through the bi-mode control valve is permitted.

16. The dual mode hydraulic actuator as in claim 10, wherein the first position corresponds to the rod being fully retracted within the housing and the second position corresponds to the rod being fully extracted from the housing and wherein the rod passes through an opening in the housing and the first chamber is disposed between the piston and the opening.

17. The dual mode hydraulic actuator as in claim 10, wherein the hydraulic actuator further comprises an inner cylinder, wherein the piston, the first chamber and the second chamber are disposed within the inner cylinder and the self contained flexible volume compensator is disposed between an outer surface of the inner cylinder and an inner surface of the housing, wherein the self contained flexible volume compensator is pre-pressurized to a predetermined level that is higher than one atmosphere but less than a pressure required to urge the piston and the rod between the first and second positions.

18. The dual mode hydraulic actuator as in claim 10, wherein the rod is a hollow cylinder and the hydraulic actuator further comprises a sensor positioned within the rod, wherein the sensor is configured to measure movement of the hollow cylinder, wherein the sensor outputs a signal indicative of a position of the rod within the housing.

19. A method for actuating a rod of a hydraulic actuator, comprising:

pressurizing a fluid in a self contained flexible volume compensator of the hydraulic actuator; and displacing a portion of the fluid of the self contained flexible volume compensator into a second chamber of the hydraulic actuator as a rod of the hydraulic actuator moves from a first position towards a second position wherein a piston coupled to the rod increases a volume of the second chamber and decreases a volume of a first chamber, wherein a portion of a fluid in the second chamber is transferred to the self contained flexible volume compensator when the rod moves from the second position to the first position, and wherein the self contained flexible volume compensator, the first chamber and the second chamber are disposed within a housing of the hydraulic actuator and a bi-mode control valve, disposed in the housing, provides selective fluid communication between the first chamber, the second chamber and the self contained flexible volume compensator as the rod moves in a range of movement defined by the first position and the second position, wherein the bi-mode control valve isolates the first chamber from the self contained flexible volume compensator and the second chamber when the bi-mode control valve is biased into a neutral position.

20. The method as in claim 19, wherein the hydraulic actuator further comprises a bidirectional pump disposed within the housing for displacing the fluid between the first chamber, the second chamber and the self contained flexible volume compensator, wherein the self contained flexible volume compensator is pre-pressurized to a predetermined level that is higher than one atmosphere but less than a pressure required to urge the piston between the first and second positions and wherein fluid from the first chamber does not directly flow into the self contained flexible volume compensator.

* * * * *